United States Patent [19]
Langenbach

[11] Patent Number: 4,461,236
[45] Date of Patent: Jul. 24, 1984

[54] DEVICE FOR INTERMITTENT APPLICATION OF GLUE

[75] Inventor: Manfred Langenbach, Gevelsberg, Fed. Rep. of Germany

[73] Assignee: Maschinenfabrik Alfred Schmermund GmbH & Co., Gevelsberg, Fed. Rep. of Germany

[21] Appl. No.: 446,392

[22] Filed: Dec. 2, 1982

[30] Foreign Application Priority Data

Dec. 4, 1981 [DE] Fed. Rep. of Germany ..... 3148037

[51] Int. Cl.³ ..... B05C 5/02
[52] U.S. Cl. ..... 118/50; 118/302; 118/325; 118/410
[58] Field of Search ..... 118/302, 410, 411, 50, 118/325; 222/571

[56] References Cited

U.S. PATENT DOCUMENTS 3,943,527 3/1976 Hartmann ..... 118/410 X

*Primary Examiner*—John P. McIntosh

[57] ABSTRACT

A gluing head comprises a valve which intermittently allows the delivery of glue to an ejection port for application to sheet material which moves relative to the head. The head is provided, downstream of the ejection port in the direction of relative motion, with a stepped recess and a low pressure source is coupled to the recess whereby glue threads formed upon the discontinuance of the delivery of glue to the ejection port will be drawn upwardly away from the sheet material.

10 Claims, 1 Drawing Figure

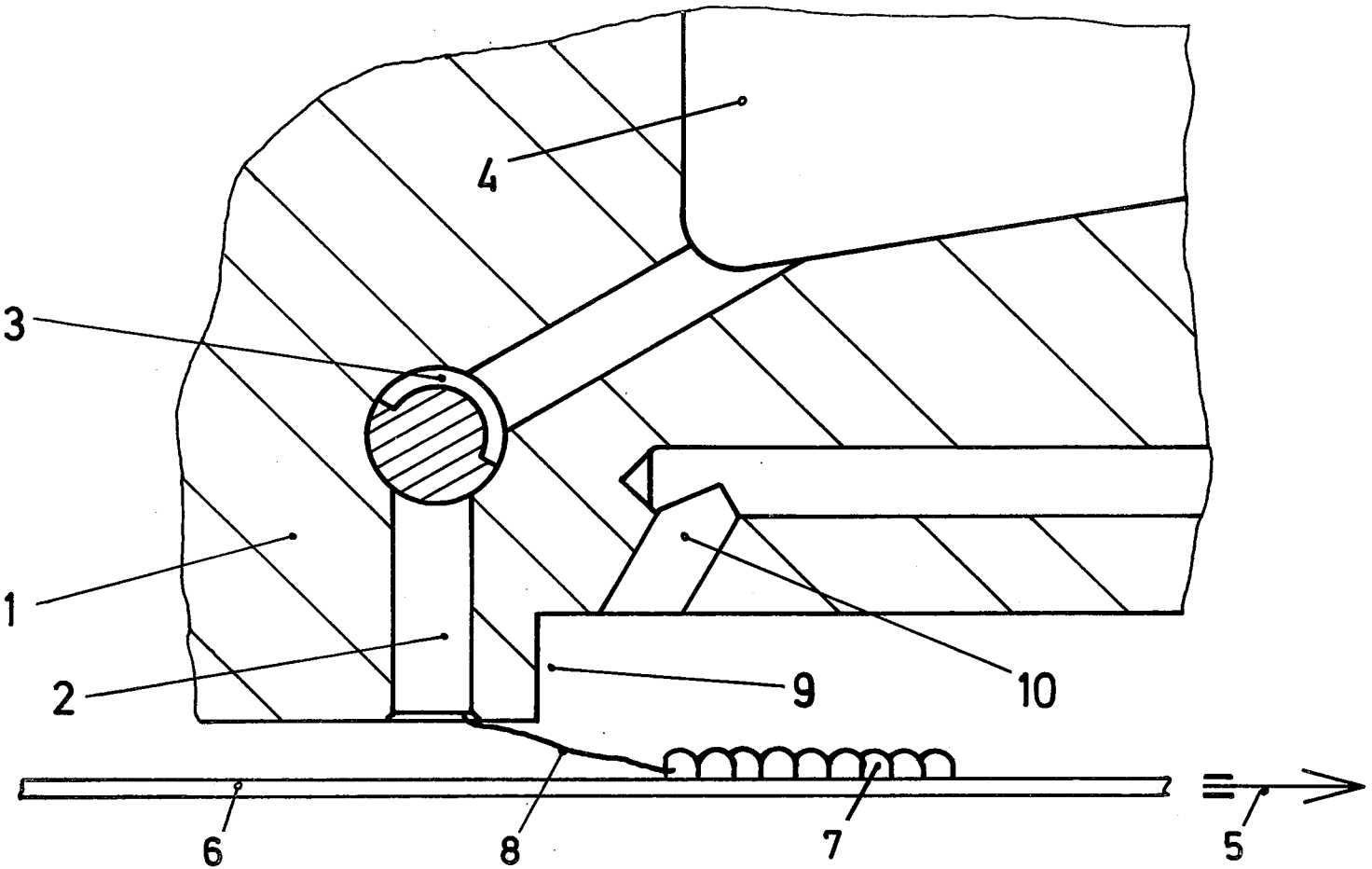
1
2
3
4
5
6
7
8
9
10

DEVICE FOR INTERMITTENT APPLICATION OF GLUE

The invention concerns a device for the intermittent application of glue to a moving material, particularly packaging sheet of material.

In packaging machines which form packages from individually cut pieces of sheet material precisely delimited strips of glue must be applied to these pieces. The application of glue in automatic packaging systems has previously been accomplished with either glue rollers or, in the case of the application of heat fused adhesives, with glue ejectors. Prior glue ejectors have had the disadvantage that after the glue flow is shut off by closing the jet between the ejecter nozzle and the glue bead on the packaging piece, glue threads are often formed and these threads are deposited on the packaging piece and are responsible for unwanted glueing.

In order to prevent the formation of the above-mentioned glue threads it has been proposed, see for example published Federal Republic of Germany Patent application Ser. No. 1 274 864, that the glue ejector be shut off in a period less than 1/100 second which should certainly eliminate thread formation. This procedure, however, is difficult to implement in packaging machines which operate at different speeds because the rapid shut off is only mechanically feasible synchronously with the machine.

Furthermore, it has been proposed, see for example published Federal Republic of Germany Patent application Ser. No. 2 709 935, that the glue be sucked back after the glue ejector was shut off. However, thread formation is not reliably prevented in this way.

The aim of the present invention is to provide a device for the application of glue which reliably prevents unwanted glueing of packaging pieces.

The above-stated objective is achieved by providing a glue ejector device with a stepped recess behind the ejector nozzle and wherein a borehole is provided in the recessed area for connection to a partial vacuum source.

The present invention also comprises a gluing technique wherein thread formation is not absolutely inhibited but steps are taken to make certain that any glue threads which may form do not stay on the packaging pieces or machines parts with which they come in contact.

The invention is illustrated in detail in the accompanying drawing which is a schematic cross-sectional view of a glueing device in accordance with the invention.

Referring now to the drawing, the device includes an ejector body 1 in which a glue nozzle or ejector 2 is fitted. Ejector 2 is connected to a glue supply 4 by a valve 3. The glue ejector 2 is shown in the off condition with valve 3 closed.

With valve 3 in the open condition, a glue bead 7 is formed on packaging pieces 6 moving in the direction of the arrow 5. In addition, a glue thread 8 is formed between the glue bead 7 and the glue ejector 2. The ejector body 1 is so designed so that it has, directly behind the glue ejector 2 in the direction of transport of the packaging pieces 6, a stepped recess 9. There is a borehole 10 in the base portion, i.e., the portion which is parallel to the direction of motion of the packaging pieces 6, of recess 9. Bore hole 10 is connected to a partial vacuum source (not shown) so that the glue thread 8 is sucked up. The borehole 10 can either be connected to the low pressure source when the valve 3 is closed or continuously connected thereto, the latter possibility being the least complicated solution and has proved to be fully operable.

I claim:

1. An applicator for adhesives comprising:

a body portion, said body portion defining a first surface adapted to be juxtapositioned to but spaced from a surface to which an adhesive is to be applied;

an ejector, said ejector being formed in said body portion and terminating at said first surface;

means for intermittently and controllably supplying adhesive in liquid form to said ejector whereby the adhesive will be discharged from the applicator and will form a bead on a surface which moves relative to said first surface;

a recess in said body portion, said recess being positioned downstream in the direction of said relative motion from the termination of said ejector, said recess being in part defined by a second surface of said body portion which is spaced from the surface to which the adhesive is applied by a greater distance than said first body portion surface; and means for establishing a low pressure in the region of said recess.

2. The apparatus of claim 1 wherein said recess is a stepped recess and is further defined by a third surface of said body portion which is generally transverse to and extends from said first surface to said second surface.

3. The apparatus of claim 2 wherein said low pressure establishing means comprises:

a suction port in said body portion second surface; and means for establishing communication between said suction port and a low pressure source.

4. The apparatus of claim 3 wherein said body portion second surface is generally parallel to said body portion first surface in the vicinity of said suction port.

5. The apparatus of claim 1 wherein said low pressure establishing means comprises:

a suction port in said body portion second surface; and means for establishing communication between said suction port and a low pressure source.

6. The apparatus of claim 5 wherein said means for intermittently supplying adhesive includes:

a flow control valve mounted in said body portion; and a flow passage providing communication between said valve and said ejector.

7. The apparatus of claim 6 further comprising:

reservoir means on said body portion, said reservoir means receiving the adhesive to be applied; and flow passage means establishing communication between said reservoir means and said valve means.

8. The apparatus of claim 6 wherein said body portion second surface is generally parallel to said body portion first surface in the vicinity of said suction port.

9. The apparatus of claim 7 wherein said body portion second surface is generally parallel to said body portion first surface in the vicinity of said suction port.

10. The apparatus of claim 8 further comprising:

reservoir means on said body portion, said reservoir means receiving the adhesive to be applied; and flow passage means establishing communication between said reservoir means and said valve means.

* * * * *